US008833909B2

(12) United States Patent
Nishitani et al.

(10) Patent No.: US 8,833,909 B2
(45) Date of Patent: Sep. 16, 2014

(54) LIQUID EJECTION HEAD AND LIQUID EJECTION METHOD

(75) Inventors: Eisuke Nishitani, Tokyo (JP); Toru Yamane, Yokohama (JP); Tomoyuki Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/559,871

(22) Filed: Jul. 27, 2012

(65) Prior Publication Data

US 2013/0050349 A1 Feb. 28, 2013

(30) Foreign Application Priority Data

Aug. 25, 2011 (JP) ..... 2011-183571

(51) Int. Cl.
*B41J 2/05* (2006.01)
*B41J 2/14* (2006.01)

(52) U.S. Cl.
CPC ..... *B41J 2/1404* (2013.01); *B41J 2002/14169* (2013.01); *B41J 2002/14177* (2013.01); *B41J 2202/11* (2013.01)
USPC ..... 347/65; 347/62

(58) Field of Classification Search
CPC ..... B41J 2002/14177; B41J 2002/14185
See application file for complete search history.

(56) References Cited

U.S. PATENT DOCUMENTS 6,154,237 A 11/2000 Kashino et al.
6,918,656 B2 * 7/2005 Koitabashi et al. ..... 347/56
6,984,025 B2 1/2006 Kaneko et al.
7,771,026 B2 8/2010 Ide et al.
7,832,843 B2 11/2010 Oikawa et al.
8,087,759 B2 1/2012 Oikawa et al.
8,096,644 B2 1/2012 Murakami et al.
2002/0012024 A1 1/2002 Lee et al.
2002/0024563 A1 2/2002 Koitabashi et al.
2003/0214552 A1 11/2003 Kaneko et al.
2004/0169700 A1 * 9/2004 Lee et al. ..... 347/56
2009/0015639 A1 1/2009 Fukui et al.

FOREIGN PATENT DOCUMENTS

CN 1157778 A 8/1997
CN 1453132 A 11/2003
CN 1533891 A 10/2004
JP 2001-150679 A 6/2001
JP 2008-238401 A 10/2008

OTHER PUBLICATIONS

Chinese Office Action dated Apr. 3, 2014, in Chinese Patent Application No. 201210306633.6.

* cited by examiner

*Primary Examiner* — Geoffrey Mruk
(74) *Attorney, Agent, or Firm* — Fitzpatrick, Cella, Harper & Scinto

(57) ABSTRACT

A liquid ejection head including: includes an ejection orifice for ejecting liquid, a pressure chamber communicating with the ejection orifice, a flow path for supplying the liquid to the pressure chamber, and a first heat-generating element and a second heat-generating element for generating energy to be used for ejecting the liquid. The first heat-generating element is arranged in the pressure chamber before the second heat-generating element with respect to a supply direction of the liquid from the flow path to the pressure chamber. A portion between the first heat-generating element and the second heat-generating element is located within a projection of an opening of the ejection orifice, when viewed from a direction in which the liquid is ejected from the ejection orifice.

8 Claims, 4 Drawing Sheets

LIQUID EJECTION HEAD AND LIQUID EJECTION METHOD

BACKGROUND OF THE INVENTION

1. Field of the Invention

The present invention relates to a liquid ejection head and a liquid ejection method for performing recording on a recording medium by ejecting liquid such as ink.

2. Description of the Related Art

There is an ink jet recording apparatus for performing recording on a recording medium such as paper by ejecting ink. A liquid ejection head capable of ejecting ink is generally mounted on the ink jet recording apparatus.

In the liquid ejection head, an ink ejection system using heat-generating elements is widely used. In such a liquid ejection head, heat-generating elements in multiple pressure chambers supply heat energy to ink to cause film boiling of the ink to generate bubbles in each pressure chamber. When the bubbles are generated, a pressure is applied to ink around the bubbles, and hence the ink in the pressure chamber is ejected from an ejection orifice placed so as to be opposed to the heat-generating element.

In the liquid ejection head using the heat-generating element, generally, the bubbles generated on the heat-generating element communicate with outside air flowing in the pressure chamber through the ejection orifice after the ejection of ink and are released from the ejection orifice together with the outside air. However, a phenomenon called cavitation may occur in which the generated bubbles remain on the heat-generating element, and the bubbles are pressed by the ink in a direction toward the heat-generating element to be split swiftly to the sides of the heat-generating element. When the cavitation occurs, the ink collides with the heat-generating element swiftly, and hence, the heat-generating element may be damaged.

Japanese Patent Application Laid-Open No. 2008-238401 discloses a liquid ejection head that prevents the occurrence of cavitation. In this liquid ejection head, the positions of ejection orifices are offset from those positions opposed to heat-generating elements to an opposite side of a common liquid chamber for supplying ink to pressure chambers.

According to the above-mentioned configuration, when ink is supplied from the common liquid chamber to the ejection orifice after the ejection of the ink, a flow of the ink in a direction toward the ejection orifice occurs on the heat-generating element. Therefore, bubbles generated on the heat-generating element are guided in a direction of the ejection orifice, following the flow of the ink, to communicate with outside air. Thus, in the liquid ejection head, the generated bubbles can be prevented from remaining on the heat-generating element, and hence, cavitation does not occur easily.

In recent years, there is a demand for an increase in density of ejection orifices in a liquid ejection head along with demands for higher image quality and higher speed of recording on a recording medium by a recording apparatus. In order to satisfy the demands, it is necessary to decrease the interval of the ejection orifices in an ejection orifice row formed of multiple ejection orifices and to decrease the interval of the respective ejection orifice rows.

On the other hand, in order to allow the heat-generating elements to generate sufficient heat energy, it is necessary to form each heat-generating element having at least a predetermined size. Therefore, in order to decrease the interval of the ejection orifices in the ejection orifice row, it is necessary to form the heat-generating elements in an elongated manner in a direction orthogonal to the ejection orifice row. However, in this case, as described in Japanese Patent Application Laid-Open No. 2008-238401, when the ejection orifices are placed on a downstream side of the heat-generating elements in a flow direction of the ink, the interval of the respective ejection orifice rows will become larger.

SUMMARY OF THE INVENTION

According to an aspect of the present invention, there is provided a liquid ejection head which includes: an ejection orifice for ejecting liquid; a pressure chamber communicating with the ejection orifice; a flow path for supplying the liquid to the pressure chamber; and a first heat-generating element and a second heat-generating element for generating energy to be used for ejecting the liquid, which are arranged in the pressure chamber in the mentioned order in a supply direction of the liquid from the flow path to the pressure chamber, in which a portion between the first heat-generating element and the second heat-generating element is located in an opening of the ejection orifice, when viewed from a direction in which the liquid is ejected from the ejection orifice.

According to another aspect of the present invention, there is provided a method of ejecting liquid which includes: providing a liquid ejection head including an ejection orifice for ejecting liquid, a pressure chamber communicating with the ejection orifice, a flow path for supplying the liquid to the pressure chamber, and a first heat-generating element and a second heat-generating element for generating energy to be used for ejecting the liquid, which are arranged in the pressure chamber in the mentioned order in a supply direction of the liquid from the flow path to the pressure chamber; causing the first heat-generating element and the second heat-generating element to generate heat to thereby push out the ink from the ejection orifice by bubbles respectively generated by the first heat-generating element and the second heat-generating element; and when the bubble generated by the heat generation of the first heat-generating element contracts, allowing the bubble to communicate with outside air that flows in from the ejection orifice, and allowing the bubble generated by the heat generation of the second heat-generating element to vanish in the liquid without communicate with the outside air.

Further features of the present invention will become apparent from the following description of exemplary embodiments with reference to the attached drawings.

DESCRIPTION OF THE EMBODIMENT

Hereinafter, an embodiment of the present invention is described with reference to the attached drawings.

Figure 1:
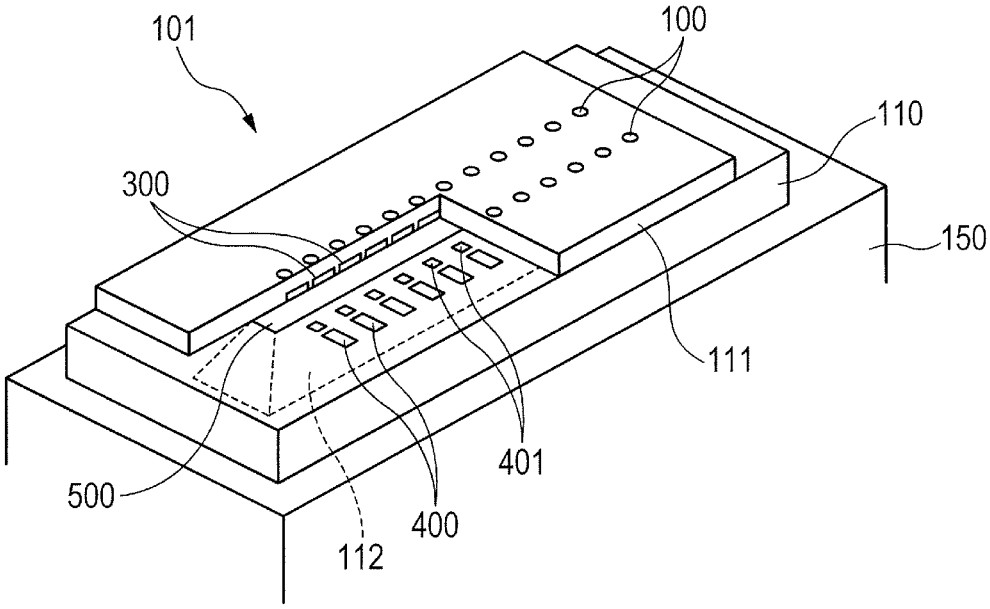
FIG. 1 is a partially cutaway perspective view illustrating a liquid ejection head according to an embodiment of the present invention.

FIG. 1 is a partially cutaway perspective view illustrating a liquid ejection head (hereinafter, also referred to as "recording head") 101 according to one embodiment of the present invention. The recording head 101 includes an ink supply member 150, a Si substrate 110, a flow path forming member 111, and the like.

The Si substrate 110 is placed on the ink supply member 150, and the Si substrate 110 is provided with a common liquid chamber 112 penetrating the Si substrate 110 in the thickness direction. The ink supply member 150 includes a flow path (not shown) for guiding ink supplied from an ink tank (not shown) to the common liquid chamber 112. The Si substrate 110 may be replaced by a substrate made of another material. Examples of the other material for forming the substrate include glass, ceramics, resin, and metal.

The flow path forming member 111 is provided on the Si substrate 110, and multiple pressure chambers 200 (see FIG. 2B) communicate with the common liquid chamber 112 of the Si substrate 110 via ink flow paths 300 respectively and are arranged in two rows. In each pressure chamber 200, two kinds of heat-generating elements (heaters) 400 and 401 formed on the Si substrate 110 and an ejection orifice 100 formed at a position opposed to the heat-generating elements 400 and 401 are provided. Reference numeral 500 denotes an ink supply port.

An insulating film (not shown) for accelerating the dispersion of heat is provided on the surface of the Si substrate 110. Further, the surfaces of the heat-generating elements 400 and 401 are covered with an insulating film (not shown) for protecting the heat-generating elements 400 and 401.

The interval of the respective ejection orifices 100 in the respective rows of the ejection orifices 100 is determined so as to be capable of recording at 1,200 dpi. In this embodiment, the ink flow paths 300 are formed at an interval of 21.2 μm. The respective rows of the ejection orifices 100 adjacent to each other are placed so as to be offset with respect to each other by a half of the interval of the ejection orifices 100 in the row direction.

Figure 2A:
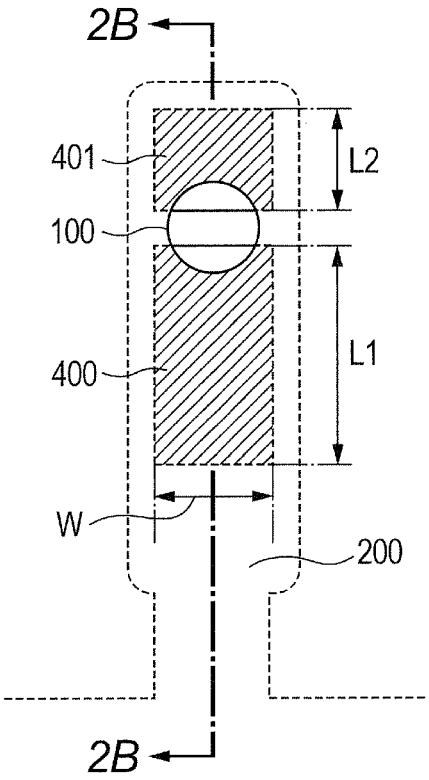
FIGS. 2A and 2B are schematic structural views illustrating the vicinity of a pressure chamber of the liquid ejection head illustrated in FIG. 1.
Figure 2B:
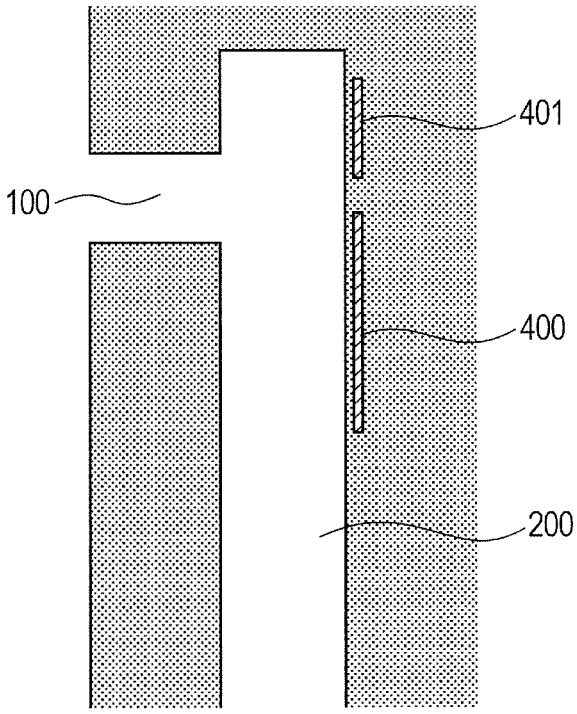

FIGS. 2A and 2B are enlarged structural views schematically illustrating the vicinity of the pressure chamber 200 of the recording head 101 illustrated in FIG. 1. FIG. 2A is a perspective plan view, and FIG. 2B is a cross-sectional view taken along line 2B-2B in FIG. 2A.

The heat-generating elements 400 and 401 are arranged at an interval in the order of the first heat-generating element 400 and the second heat-generating element 401 from a side closer to the ink flow path 300. The heat-generating elements 400 and 401 each have a rectangular shape, and the length of the side perpendicularly intersecting the ink flow path 300 of the heat-generating elements 400 and 401 is a predetermined length W. Regarding the length of the side in the direction of the ink flow path 300, the first heat-generating element 400 has a predetermined length L1 and the second heat-generating element 401 has a predetermined length L2. The side of the first heat-generating element 400 in the direction of the ink flow path 300 is longer than that of the second heat-generating element 401, and more specifically, a relationship of L1>L2 is satisfied. Thus, the surface area of the first heat-generating element 400 is larger than that of the second heat-generating element 401. In this embodiment, the length W is 10.2 μm, the length L1 is 34.6 μm, and the length L2 is 8.9 μm.

In this embodiment, an effective bubbling region of the first heat-generating element 400 is a region on an inner side of a portion 2 μm from the outer periphery of the first heat-generating element 400. Thus, the length of the effective bubbling region of the heat-generating elements 400 and 401 in the direction along a direction intersecting the ink flow path 300 is 6.2 (=10.2−4.0) μm. Further, the length of the effective bubbling region of the first heat-generating element 400 in the direction along a direction of the ink flow path 300 is 30.6 (=34.6−4.0) μm. The length of the effective bubbling region of the second heat-generating element 401 in the direction along the direction of the ink flow path 300 is 4.9 (=8.9−4.0) μm.

Thus, the area of the effective bubbling region of the first heat-generating element 400 is 189.72 (=30.6×6.2) $\mu m^2$, and the area of the effective bubbling region of the second heat-generating element 401 is 30.38 (=4.9×6.2) $\mu m^2$. Thus, in each pressure chamber 200, the total area of the effective bubbling regions of the first heat-generating element 400 and the second heat-generating element 401 is 220.1 $\mu m^2$ (189.72+30.38).

The ejection pressure of ink from the ejection orifice 100 by the recording head 101 depends upon heat energy generated by the heat-generating elements 400 and 401. Then, the heat energy generated by the heat-generating elements 400 and 401 depends upon the total area of the effective bubbling regions of the first and second heat-generating elements 400 and 401. In this embodiment, the areas of the effective bubbling regions of the first and second heat-generating elements 400 and 401 are determined so as to obtain a sufficient ejection pressure of ink.

Accordingly, the recording head 101 according to this embodiment can generate heat energy sufficient for ejecting ink from the ejection orifices 100 by the heat-generating elements 400 and 401.

The ejection orifice 100 is opposed to a portion between the first heat-generating element 400 and the second heat-generating element 401 and is partially opposed to both the heat-generating elements 400 and 401. This enables heat energy generated by the two kinds of heat-generating elements 400 and 401 to be efficiently used for ejecting ink.

Figure 3:
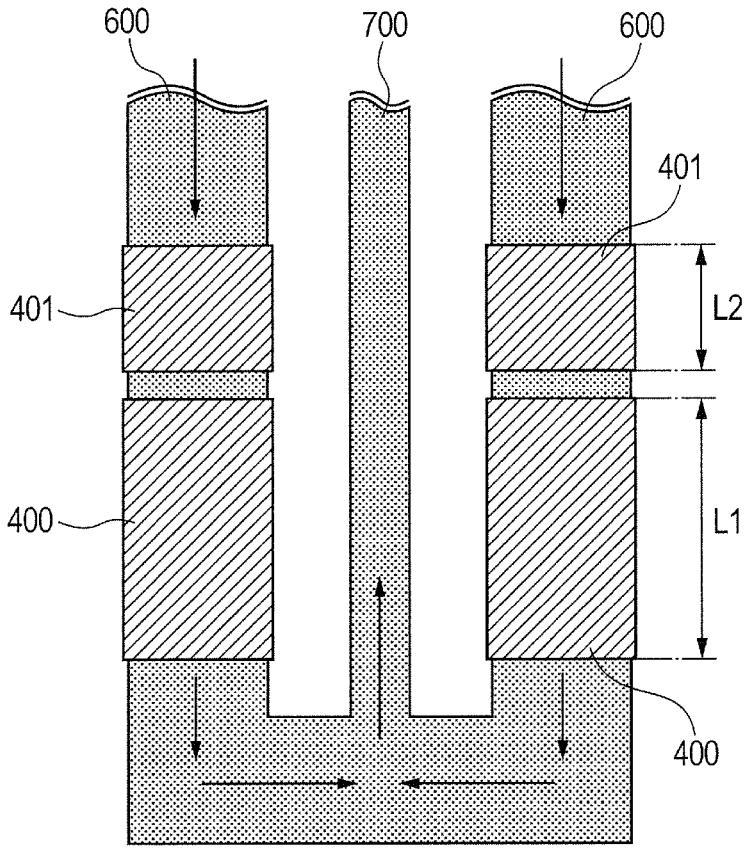
FIG. 3 is a view illustrating electric wiring of the liquid ejection head illustrated in FIG. 1.

FIG. 3 is a view illustrating electric wiring for supplying power to the heat-generating elements 400 and 401. Each pressure chamber 200 is provided with separate wiring 600. When the first and second heat-generating elements 400 and 401 connected in series are supplied with power by the separate wiring 600, the heat-generating elements 400 and 401 generate heat energy simultaneously. As described above, the widths W of the heat-generating elements 400 and 401 are substantially equal to each other, and hence, electric resistivities thereof are also substantially equal to each other. Further, the heat-generating elements 400 and 401 in the adjacent pressure chambers 200 share common wiring 700, and the separate wirings 600 are grounded through the common wiring 700.

Next, a method of ejecting liquid by the recording head 101 according to the present embodiment and the behavior of bubbles at a time of ejection of ink are described with reference to FIGS. 4A to 4E. FIGS. 4A to 4E are enlarged sectional side elevations illustrating the vicinity of the pressure chamber 200 of the recording head 101.

Figure 4A:
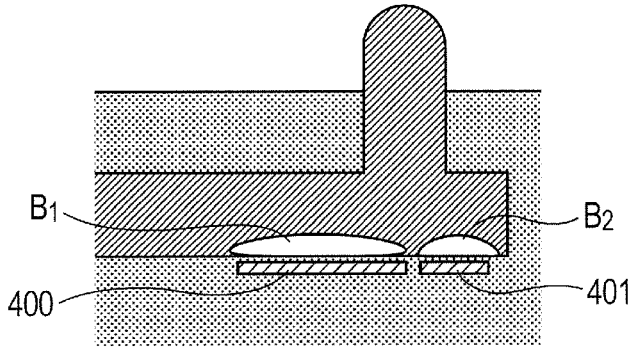
FIGS. 4A, 4B, 4C, 4D and 4E are views illustrating the behavior of bubbles at a time of ink ejection in the liquid ejection head illustrated in FIG. 1.

FIG. 4A illustrates a state in which the first heat-generating element 400 and the second heat-generating element 401 generate heat energy simultaneously. The first heat-generating element 400 forms a bubble $B_1$ and the second heat-generating element 401 forms a bubble $B_2$. Thus, ink is pushed out and protrudes from the ejection orifice 100 (first stage).

As described above, the area of the effective bubbling region of the first heat-generating element 400 is larger than that of the second heat-generating element 401. Therefore, the heat energy generated by the first heat-generating element 400 is larger than that of the second heat-generating element 401. Thus, the bubble $B_1$ will be larger than the bubble $B_2$.

Figure 4B:
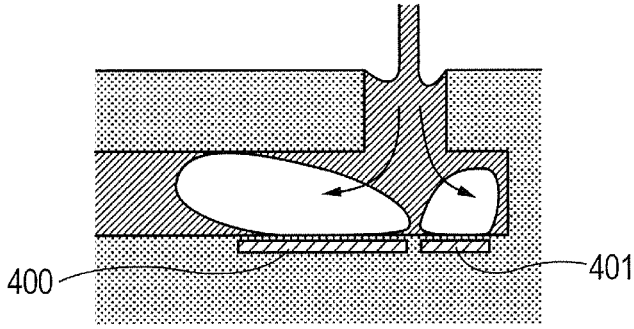

FIG. 4B illustrates a state immediately after ink has been ejected from the ejection orifice 100 after the first stage. The force for sucking the outside air in an amount depending upon the amount of the ejected ink into the ejection orifice 100 acts on the ink. Thus, the ink provides forces in arrow directions to the bubbles $B_1$ and $B_2$.

Figure 4C:
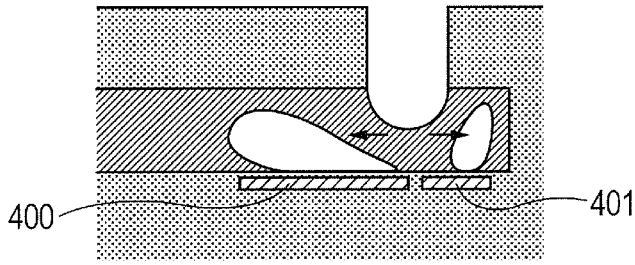

FIG. 4C illustrates a state in which the outside air flows into the pressure chamber 200 (see FIG. 2B) via the ejection orifice 100. At this time, the ink provides forces in arrow directions to the bubbles $B_1$ and $B_2$. On the other hand, ink in an amount depending upon the amount of the ejected ink is supplied in the direction from the ink flow path 300 to the pressure chamber 200 along with the contraction of the bubbles $B_1$ and $B_2$. The ejection orifice 100 is formed on a downstream side of the first heat-generating element 400 in the flow direction of the ink, and hence, the bubble $B_1$ is swept to the ejection orifice 100 side by the ink. At this time, the bubbles $B_1$ and $B_2$ are independently present in the ink (second stage).

Figure 4D:
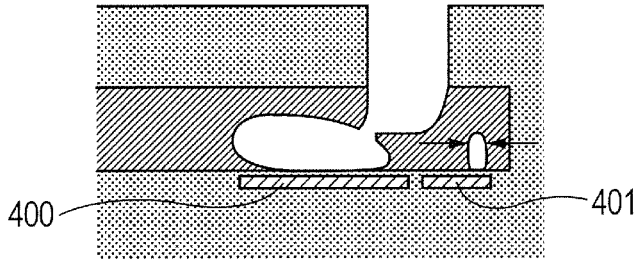

FIG. 4D illustrates a state in which the ink is being supplied from the ink flow path 300 to the ejection orifice 100. The bubble $B_1$ is swept by the ink to communicate with the outside air that flows in. Further, at this time, the ink in the pressure chamber 200 is in a pressure applied state, and hence, the bubble $B_2$ is compressed by the ink.

Figure 4E:
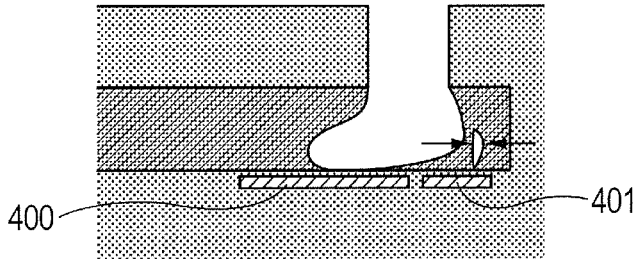

FIG. 4E illustrates a state after the state illustrated in FIG. 4D. The bubble $B_1$ that communicates with the outside air is taken in the outside air. On the other hand, the bubble $B_2$ is further compressed by the ink to be eliminated. Along with this, the pressure chamber 200 and the ejection orifice 100 are filled with the ink (third stage).

As described above, the first heat-generating element 400 is located on an upstream side of the ejection orifice 100 in the flow direction of the ink directed from the ink flow path 300 to the ejection orifice 100, and hence, the bubble $B_1$ is swept to move in the direction of the ejection orifice 100, following the flow of the ink. Therefore, in the first heat-generating element 400, the bubble $B_1$ does not remain on the first heat-generating element 400, and thus, cavitation does not occur.

The center position of the second heat-generating element 401 is shifted from the center position of the ejection orifice 100, and hence, the bubble $B_2$ is not easily influenced by a force in the direction from the ink to the second heat-generating element 401. Further, regarding the second heat-generating element 401, the bubble $B_1$ generated by the first heat-generating element 400 and the bubble $B_2$ generated by the second heat-generating element 401 pull each other, and the speed of eliminating the bubble generated by the second heat-generating element 401 is decreased. Thus, the bubble $B_2$ is eliminated slowly while undergoing a pressure from the surrounding ink. Therefore, cavitation does not occur in the second heat-generating element, either.

Accordingly, in the recording head 101 according to the present embodiment, cavitation does not occur in the heat-generating elements 400 and 401.

Owing to the above-mentioned configuration, in the recording head 101, the interval of the ejection orifices in the row direction thereof can be decreased, and the interval between the respective ejection orifice rows can also be decreased. Therefore, in the recording head using this configuration, recording at 600 dpi or more can be performed without causing cavitation on the heat-generating elements. In the recording head 101 according to the present embodiment, recording at 1,200 dpi can be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-183571, filed Aug. 25, 2011, which is hereby incorporated by reference herein in its entirety.

What is claimed is:

1. A liquid ejection head, comprising:

an ejection orifice for ejecting liquid;

a pressure chamber communicating with the ejection orifice;

a flow path for supplying the liquid to the pressure chamber; and a first heat-generating element and a second heat-generating element for generating energy to be used for ejecting the liquid, which are arranged in the pressure chamber in the mentioned order in a supply direction of the liquid from the flow path to the pressure chamber, wherein an area of the first heat-generating element is larger than an area of the second heat-generating element, wherein the first heat-generating element has a rectangular shape which is long in the supply direction, and wherein a portion between the first heat-generating element and the second heat-generating element is located within a projection of an opening of the ejection orifice, when viewed from a direction in which the liquid is ejected from the ejection orifice.

2. The liquid ejection head according to claim 1, wherein an interval between the first heat-generating element and the second heat-generating element is smaller than a diameter of the ejection orifice.

3. The liquid ejection head according to claim 1, wherein the first heat-generating element and the second heat-generating element are connected in series via wiring.

4. The liquid ejection head according to claim 1, wherein a dimension of the first heat-generating element and a dimension of the second heat-generating element in a direction perpendicular to the supply direction are substantially equal to each other.

5. The liquid ejection head according to claim 1, wherein an electric resistivity of the first heat-generating element and an electric resistivity of the second heat-generating element are substantially equal to each other.

6. The liquid ejection head according to claim 1, wherein a part of an end of the first heat-generating element on the second heat-generating element side and a part of an end of the second heat-generating element on the first heat-generating element side, viewed from the direction in which the liquid is ejected from the ejection orifice, are located in within the projection of the opening of the ejection orifice.

7. The liquid ejection head according to claim 1, wherein a ratio of a dimension of the first heat-generating element in the supply direction with respect to a dimension thereof in a direction perpendicular to the supply direction is greater than a ratio of a dimension of the second heat-generating element in the supply direction with respect to a dimension thereof in the direction perpendicular to the supply direction.

8. The liquid ejection head according to claim 1, wherein upon application of drive signals, a bubble generated by driving of the first heat-generating element communicates with the atmosphere, and a bubble generated by driving of the second heat-generating element is eliminated without communicating with outside air.

* * * * *